US009322142B2

(12) United States Patent
Bergendahl et al.

(10) Patent No.: US 9,322,142 B2
(45) Date of Patent: Apr. 26, 2016

(54) IN-SITU SCOUR TESTING DEVICE

(71) Applicants: Bart S. Bergendahl, Litteton, CO (US); Kornel Kerenyi, Oakton, VA (US)

(72) Inventors: Bart S. Bergendahl, Litteton, CO (US); Kornel Kerenyi, Oakton, VA (US)

(73) Assignee: The U.S. Department of Transportation, Federal Highway Administration, Washington, DC (US)

( * ) Notice: Subject to any disclaimer, the term of this patent is extended or adjusted under 35 U.S.C. 154(b) by 302 days.

(21) Appl. No.: 13/958,787

(22) Filed: Aug. 5, 2013

(65) Prior Publication Data

US 2015/0033842 A1 Feb. 5, 2015

(51) Int. Cl.
*E21B 49/00* (2006.01)
*E02D 1/02* (2006.01)

(52) U.S. Cl.
CPC ..... *E02D 1/022* (2013.01)

(58) Field of Classification Search
None
See application file for complete search history.

(56) References Cited

U.S. PATENT DOCUMENTS 5,191,787 A * 3/1993 Hanson ..... 73/86
5,243,850 A * 9/1993 Hanson ..... 73/86
5,331,847 A * 7/1994 Hanson ..... G01N 33/24 73/86
6,909,669 B1 * 6/2005 Yankielun et al. ..... 367/131
2009/0000361 A1 * 1/2009 Bloomquist ..... G01N 3/24 73/86
2011/0012728 A1 * 1/2011 McCane et al. ..... 340/539.1
2012/0303276 A1 * 11/2012 Bower ..... 702/2

FOREIGN PATENT DOCUMENTS

GB 1176595 A * 1/1970 ..... E02D 1/022

* cited by examiner

*Primary Examiner* — Andre Allen

(74) *Attorney, Agent, or Firm* — Charles R. Ducker, Jr.

(57) ABSTRACT

A field testing device usable to determine the scour-depth potential of soils relied upon to support structural foundations placed in flowing water is disclosed. The device measures the scour potential in-situ, in relative terms, to the scour potential of fine sand using a columnar containment vessel driven into the soil to be tested. Within the columnar containment vessel is a cutting head as an aid in directing a water flow in a generally horizontal direction across the surface of the soil to be tested. Additionally, the cutting head serves to aid in the evacuation of eroded soil from with the containment vessel through an exhaust port. The exhaust port is part of a continuous closed loop water system which provides water for the scour testing and then removes the used water along with eroded soil particulates.

20 Claims, 3 Drawing Sheets

IN-SITU SCOUR TESTING DEVICE

FIELD OF THE DISCLOSURE

The disclosure relates in general to testing devices. More particularly, the present disclosure relates to a device for estimating the scour-depth potential of soils relied upon to support structural foundations located in flowing water. Most precisely, the present disclosure is directed to a field testing device for measuring the scour-depth potential of soils in-situ utilizing a confined flow of water having a defined shear stress and symmetrical pressure distribution across the soil surface test site.

SUMMARY OF THE DISCLOSURE

An in-situ scour testing device for more accurately determining the scour-depth potential of soils relied upon to support structural foundations placed in flowing water is disclosed. The device measures the scour potential in-situ, in relative terms, to the scour potential of fine sand using a columnar containment vessel driven into the soil to be tested at a rate commensurate to the erosion experienced during testing.

The containment vessel has an open end which is driven into the soil to isolate a core sample of soil within the containment vessel to be tested. A closed loop water system, including a variable-speed pump and a filtration system for removing scour debris from the water within the closed loop system, provides a controlled representative water flow across the surface of the core sample within the containment vessel to simulate the horizontal flow of the free flowing water outside the containment vessel.

Within the columnar containment vessel is a cutting head as an aid in directing the representative water flow in a generally horizontal direction across the surface of the soil to be tested. Additionally, the cutting head serves to aid in the evacuation of eroded soil from with the containment vessel through an included exhaust port. The exhaust port is part of the closed loop water system. The exhausted scour debris is removed from the closed loop system by use of a filtration medium prior to re-introducing the water into the portion of the closed loop water system that returns water to the containment vessel to be used again.

Various measurements relating to the scour potential of the in-situ soil can be determined from use of the presently disclosed device, including the minimum safe depth for the placement of required foundation supports, the rate of scour in relation to the speed of the water flow, the scour potential for the various soil types occurring at various depths in relation to a defined scour rate for fine sand, and others.

Additional advantages of the disclosure are set forth in, or will be apparent to those of ordinary skill in the art from, the detailed description as follows. It should also be appreciated that modifications and variations to the specifically illustrated and discussed features and materials hereof may be practiced in various embodiments and uses of this disclosure without departing from the spirit and scope thereof. Such variations may include, but are not limited to, substitutions of equivalent means, features, and materials for those shown or discussed, and the functional or positional reversal of various parts, features or the like.

Still further, it is to be understood that different embodiments of this disclosure may include various combinations or configurations of presently disclosed features, elements, or their equivalents (including combinations of features or configurations not expressly shown in the figures or stated in the detailed description).

These and other features, aspects and advantages of the present disclosure will become better understood with reference to the following descriptions and appended claims. The accompanying drawings, which are incorporated in and constitute a part of this specification, illustrate at least one embodiment and, together with the descriptions, serve to explain the principles of the disclosure.

BRIEF DESCRIPTION OF THE DRAWINGS

A full and enabling disclosure, directed to one of ordinary skill in the art, is set forth in this specification, which makes reference to the appended figures, in which.

Figure 1:
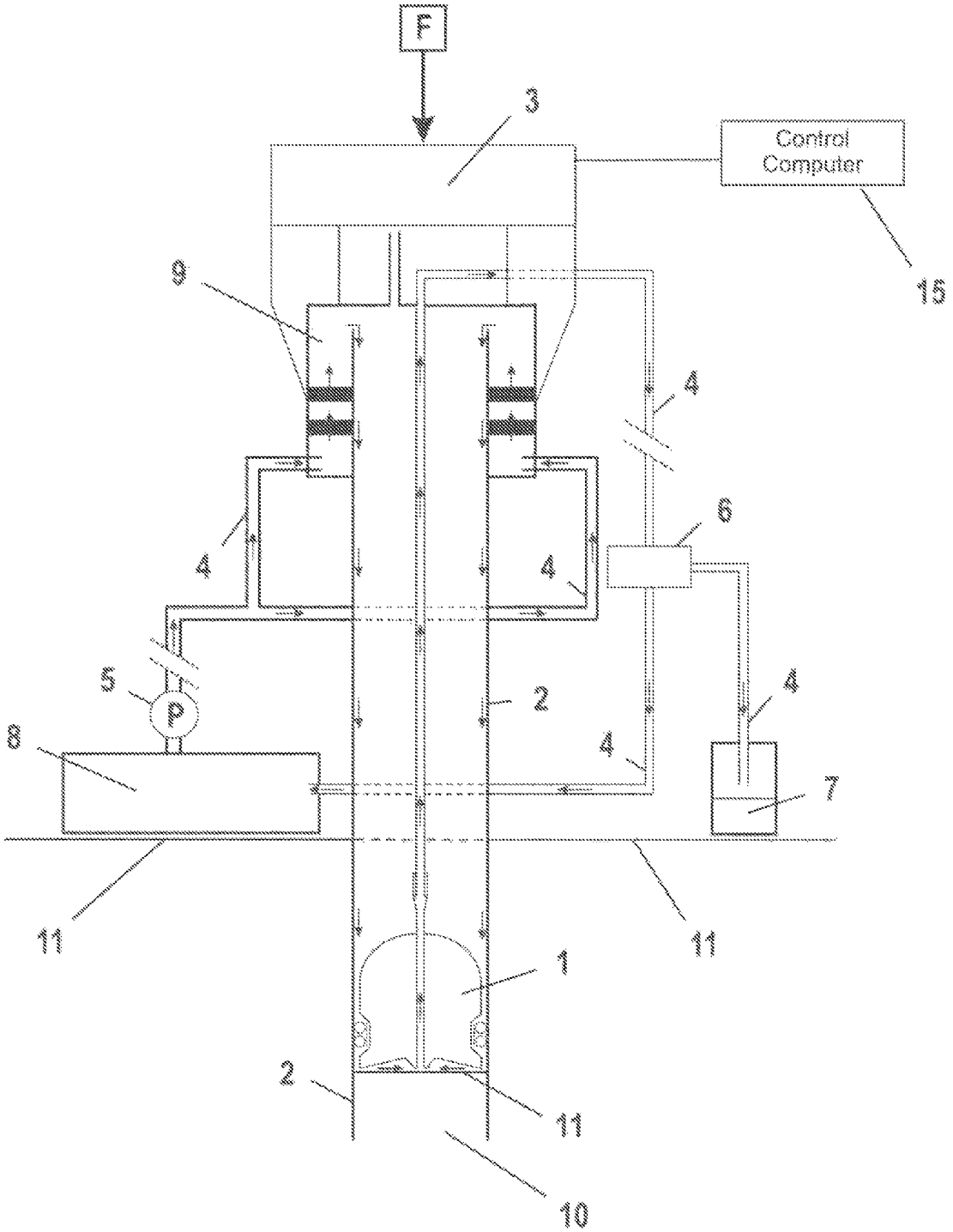
FIG. 1 is cross-sectional view of one embodiment of the presently disclosed device in operation with arrows indicating the flow path of water introduced into the system.

Repeated use of reference characters throughout the present specification and appended drawings is intended to represent the same or analogous features or elements of the present disclosure.

DETAILED DESCRIPTION

Reference will now be made in detail to the presently preferred embodiment or embodiments of the disclosure, examples of which are fully represented in the accompanying drawings. Such examples are provided by way of an explanation of the disclosure, not a limitation thereof. It should be apparent to those of ordinary skill in the art that various modifications and variations can be made to the presently disclosed embodiments without departing from the spirit and scope thereof. For instance, features illustrated or described as part of one embodiment may be used on another embodiment to yield a further embodiment. Still further, variations in selection of materials and/or characteristics may be practiced, to satisfy particular desired user criteria. Thus, it is intended that the present disclosure cover such modifications and variations as coming within the scope of the present features and their equivalents.

As disclosed above the present invention is particularly concerned with measuring, relative to fine sand, the scour-depth potential of soils relied upon to support structure foundations placed in flowing water.

FIG. 1 shows one embodiment of the claimed device, wherein a columnar containment vessel (2) having a capped end (9) and an open end (10) is inserted into an area of soil (11) which is to be tested in-situ, to depth for its scour potential. The outer walls of the containment vessel (2) along with the soil (11) serve to seal the open end (10) of the containment vessel (2) from the exterior. Suspended within and generally co-axially with the longitudinal axis of the containment vessel (2) is a freely-pistoning cutting head (1).

Associated with the capped end (9) of the containment vessel (2) is a closed loop water system (4, 5, 6, 7, 8 and 13) for pumping water into and out of the containment vessel (2) to simulate the scour potential of flowing water across the soil (11) surface enclosed within the open end (10) of the containment vessel (2). The closed loop water system (4, 5, 6, 7, 8 and 13) begins with water reservoir (8) which retains an amount of water sufficient to fill the containment vessel (2) and the remainder of the closed loop system (4, 5, 6, 7 and 8). A variable-speed pump (5) draws water out of the reservoir (8) and pushes it through circulation piping (4) into the containment vessel (2) near the capped end (9). It is preferred that the water be introduced at multiple locations near the capped end (9) of the containment vessel (2) to prevent any artificial scour due to the introduction of the water at only a single point about the inner perimeter of the vessel (2).

Figure 2:
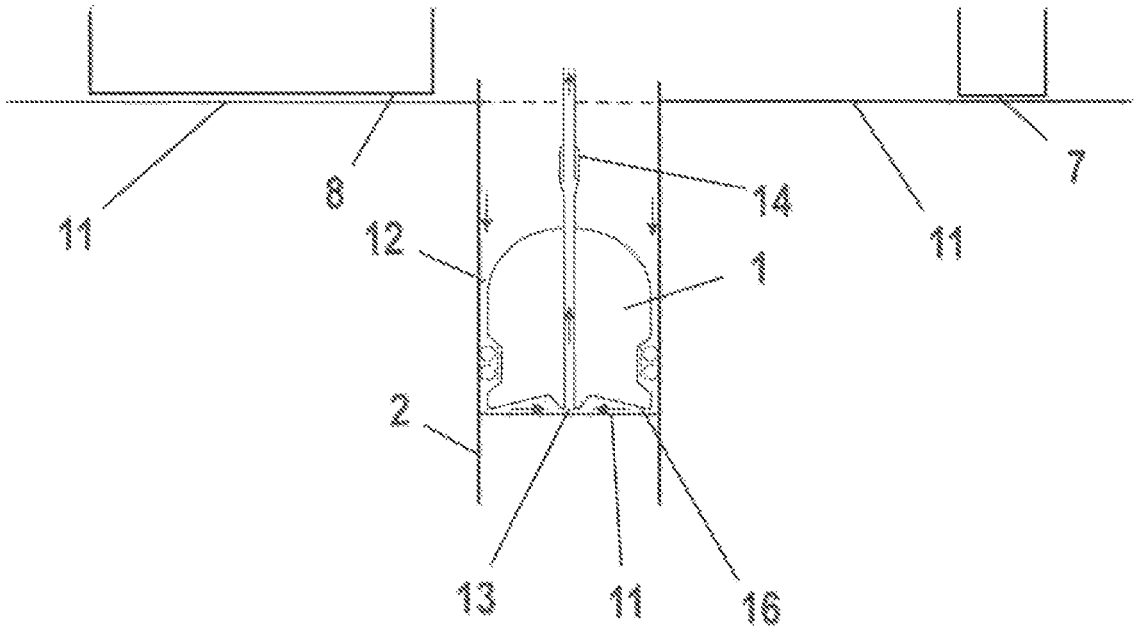
FIG. 2 is a close-up cross-sectional view of the cutting head within the capped containment vessel in the embodiment of FIG. 1.

As best seen in FIG. 2, a generally uniform column of water within the containment vessel (2) will allow for a uniform flow of water through an annular space (12) between the outer diameter of the cutting head (1) and the inner wall of the containment vessel (2) without the creation of vortices which could serve to further introduce an artificial scour effect to the testing. Such generally uniform flow of water is directed by the cutting head (1) so as to flow horizontally across the surface of the soil (11) simulating the scour potential in-situ. The flow rate of the water introduced into the containment vessel (2) and thus across the surface of the soil (11) can be controlled to correlate more closely to the existing natural conditions at the site being tested. This may be achieved through any known methodology, including, but not limited to, increasing or decreasing the pump (5) pressurization or altering the annular spacing (12) between the cutting head (1) outer diameter and the containment vessel (2) inner wall at the initiation of the test.

In operation, the open end (10) of the containment vessel (2) is advanced into the soil (11) by an external driving device (3) controlled by a sensor (14) located above the cutting head (1), and various control computers (15). The rate of advance of the open end (10) of the containment vessel (2) is determined by the relative resistance of the soil (11) to the artificial erosion and the shear characteristics generated by the water flowing over the soil (11) surface beneath the cutting head (1). Mechanically, this is measured as a resistance to the free-pistoning cutting head (1) fully extending within the containment vessel. The sensor (14) comprises two parts. The first is located on an inner wall of the columnar containment vessel and the corresponding second part is located above the cutting head on the outside wall of a portion of circulation piping (4) associated with exhaust port (13). The shear characteristics of the flowing water may be artificially varied (i.e., lowered) with increasing depth into the soil (11) to better simulate the natural decay of the scouring mechanism with depth.

The variable-speed pump (5) pushes water into the containment vessel (2), through the annular space (12) between the inner wall of the vessel (2) and the outer diameter of the cutting head (1) and horizontally across the surface of the soil (11). Such flow of water creates scour debris. As part of the closed loop water system (4, 5, 6, 7, 8 and 13), the cutting head (1) includes a centrally located exit port (13) for exhausting water and scour debris from beneath the cutting head (1). Additional circulation piping (4) carries the exhaust water and scour debris through the exhaust port (13) to a filter (6). The filter (6) allows clean water to return to the water reservoir (8) for re-use while directing the scour debris to a collection and removal vessel (7).

The containment vessel (2) will cease advancing into the soil (11) when equilibrium between the shearing force of the flowing water and the erosion resistance of the in-situ soil (11) is reached. The depth reached by the cutting head bottom surface (16) can then be compared to the worst case scenario determined through traditional empirical equations to adjust the minimum required construction depth for structural foundations used to support constructions in-situ.

Figure 3:
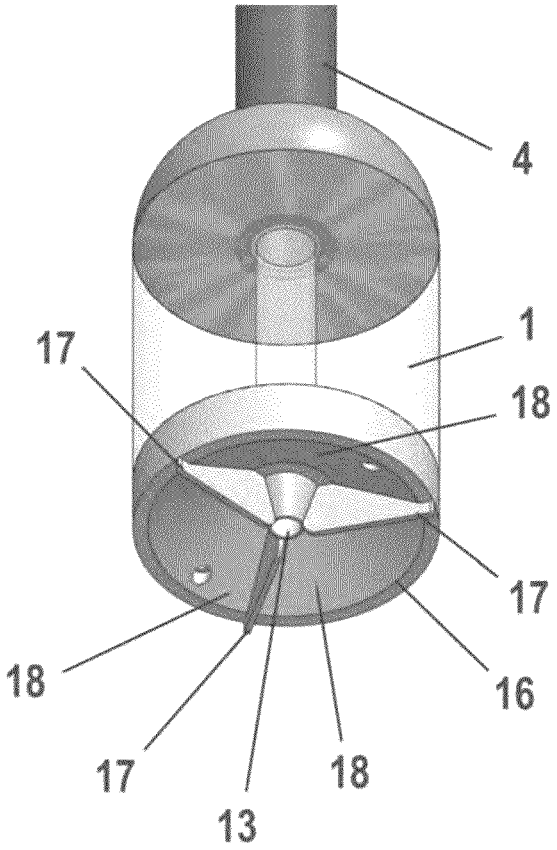
FIG. 3 is a close-up photograph of an exemplary cutting head design for ensuring generally horizontal flow of the water flowing between the cutting head and the exposed surface of the soil being tested.

FIG. 3, shows the cutting head (1) of the present embodiment in which there are provided a plurality of vanes (17) for directing the water, in coordination with the surface of the soil (11) into a generally horizontal flow pattern from the outer perimeter of the cutting head (1) towards the center of the cutting head (1) to the exhaust port (13). The plurality of directing vanes (17) extending from the bottom (16) of the cutting head (1) allow for individualized segments (18) of the cutting head's bottom surface (16) to be utilized to more uniformly flow the water across the soil (11) surface and thus, more accurately simulate the scour potential in-situ by assuring a more symmetrical pressure distribution across the entirety of the surface of the soil (11) being tested. The cutting head's bottom surface (16) is generally concave in shape to further reduce the unintended introduction of vortices or other adverse flow characteristics which would affect the accuracy of the in-situ measured scour potential.

In the disclosed embodiment, it is preferred that the columnar containment vessel (2) is made of steel, however, it should be noted that any suitably resilient material sufficient to withstand the normal wear-and-tear to be expected on such a testing device would be acceptable for use in the present device. Similarly, while the containment vessel (2) is defined as generally columnar or tubular, any shape suitable to assure functionality of the device while retaining accuracy of the measurements taken would be suitable for the purposes of the present disclosure. Still further, while the shape of the cutting head's bottom surface (16) and the plurality of vanes (17) extending therefrom have been chosen to assure a symmetrical pressure distribution while allowing a controlled flow rate of the water to more accurately simulate the natural conditions of the site being tested, alternative shapes and numbers of vanes are contemplated by the present disclosure that would similarly assure such performance characteristics.

Although a detailed description of one embodiment of the present disclosure has been expressed using specific terms and devices, such description is for illustrative purposes only. The words used are words of description rather than of limitation. It is understood that changes and variations may be made by those of ordinary skill in the art without departing from the spirit or scope of the present disclosure, which is set forth in the following claims. Additionally, it should be understood that aspects of various other embodiments may be interchanged either in whole or in part. Therefore, the spirit and scope of the appended claims should not be limited to the detailed description contained herein.

What is claimed is:

1. A device for measuring in-situ, at depth the erosion potential of soils relied upon to support structural foundations located in moving water, said device comprising:

a generally columnar containment vessel having a cap at a first end and an open second end;

a closed loop water system associated with said columnar containment vessel suited to introduce water into said columnar containment vessel and providing a-passage for removing said water and scour debris from said containment vessel; and wherein an external force drives said columnar containment vessel open second end into an exposed surface of a soil bed to be tested until a shear stress level at said exposed surface of said soil bed is equal to the resistance of said exposed surface of said soil bed to further erosion.

2. The device of claim 1, further comprising a freely-pistoning cutting head generally coaxially located within said columnar containment vessel from said first end to near said open second end thereof.

3. The device of claim 2, wherein said cutting head introduces a generally uniform distribution of pressure and shear stress at an interface between said exposed surface of the soil within said columnar containment vessel and a bottom surface of said cutting head.

4. The device of claim 3, wherein said cutting head includes a plurality of sensors for detecting the resistance to said free-pistoning cutting head full extension for supplying feedback to at least one control computer for determination of said external force driving said columnar containment vessel open end into said exposed surface of the soil.

5. The device of claim 4, wherein said passage for the removal of water having flowed across said exposed surface of the soil within the columnar containment vessel and any resultant scour debris is centrally located within said cutting head.

6. The device of claim 5, wherein said closed loop water system includes a variable-speed pump.

7. The device of claim 6, wherein said closed loop water system includes a filtration system suited to remove said scour debris from said closed loop system.

8. The device of claim 2, wherein said cutting head further comprises a centrally located exhaust port for allowing the passage of water having flowed across said exposed surface of the soil within the columnar containment vessel and any resultant scour debris.

9. The device of claim 8, wherein said closed loop water system includes a variable-speed pump.

10. The device of claim 9, wherein said closed loop water system includes a filtration system suited to remove said scour debris from said closed loop system.

11. A device for measuring in-situ, at depth the erosion potential of soils relied upon to support structural foundations located in moving water, said device comprising:

a generally columnar containment vessel having a cap at a first, end and an open second end;

a closed loop water system associated with said columnar containment vessel suited to introduce water to said columnar containment vessel and providing a passage for removing said water and scour debris from said columnar containment vessel;

a freely-pistoning cutting head having a concave-shaped bottom portion and a plurality of directing vanes suspended therefrom; and wherein an external force drives said columnar containment vessel open second end into an exposed surface of a soil bed to be tested, said external force quantity and duration being determined by a control computer.

12. The device of claim 11, wherein said freely-pistoning cutting head is generally coaxially located within said columnar containment vessel from said first end to near said open second end thereof.

13. The device of claim 12, wherein said cutting head introduces a generally uniform distribution of pressure and shear stress at an interface between said exposed surface of the soil within said columnar containment vessel and said concave-shaped bottom portion of said cutting head.

14. The device of claim 13, wherein said control computer calculates said external forces' quantity and duration on feedback supplied by a sensor located above said freely-pistoning cutting head.

15. The device of claim 14, wherein said passage for removing said water and scour debris from said columnar containment vessel is centrally located in said cutting head bottom surface.

16. The device of claim 15, wherein said closed loop water system includes a variable-speed pump and a filtration system suited to remove said scour debris from said closed loop system.

17. A device for measuring in-situ, at depth the erosion potential of soils relied upon to support structural foundations located in moving water, said device comprising:

a generally columnar containment vessel having a cap at a first end and an open second end;

a closed loop water system associated with said columnar containment vessel suited to introduce water to said columnar containment vessel near said first end and providing a passage for removing said water and scour debris from said columnar containment vessel near said open second end;

a freely-pistoning cutting head generally coaxially located within said columnar containment vessel from said first end to near said open second end thereof;

wherein an external force drives said columnar containment vessel open second end into an exposed surface of a soil bed to be tested, said external force quantity and duration being determined by a control computer; and wherein said freely-pistoning cutting head has a concave-shaped bottom portion surface and a plurality of directing vanes suspended therefrom for directing said water horizontally across said exposed surface of the soil within the columnar containment vessel so as to simulate scour in-situ.

18. The device of claim 17, wherein said horizontally directed water generates a generally uniform pressure distribution and shear stress at an interface between said exposed surface of the soil within said columnar containment vessel and said bottom surface of said cutting head.

19. The device of claim 17, wherein said passage for removing said water and scour debris from said columnar containment vessel is centrally located on said bottom surface of said cutting head.

20. The device of claim 17, wherein said cutting head includes a sensor for providing feedback to said control computer for determining said external force quantity and duration.

* * * * *